US006634513B1

(12) United States Patent
Hardy et al.

(10) Patent No.: US 6,634,513 B1
(45) **Date of Patent: *Oct. 21, 2003**

(54) STACKING CANDLE HOLDER MODULES

(75) Inventors: Christopher Hardy, Springfield, IL (US); Jason Walsh, Springfield, IL (US)

(73) Assignee: Design Ideas, Ltd., Springfield, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/219,521

(22) Filed: Dec. 23, 1998

(51) Int. Cl.[7] ..... A47B 43/00

(52) U.S. Cl. ..... 211/194; 431/291; D6/9; D26/13

(58) Field of Search ..... 211/194, 13.1; D6/9; D26/13; 431/290, 289, 297, 295, 291, 292

(56) References Cited

U.S. PATENT DOCUMENTS

| | | | | | |
|---|---|---|---|---|---|
| 436,118 | A | * | 9/1890 | Blume | 431/295 |
| 1,975,522 | A | | 10/1934 | Swobe | |
| 2,115,962 | A | | 4/1938 | Orme | 240/2 |
| 2,520,892 | A | * | 8/1950 | Roethel | 249/117 |
| D177,236 | S | | 3/1956 | Johnson | |
| 2,795,124 | A | | 6/1957 | Bruce | 67/25 |
| D192,259 | S | | 2/1962 | Baron | D48/2 |
| D193,630 | S | | 9/1962 | Quistgaard | |
| 3,141,808 | A | * | 7/1964 | Wellens | 428/27 |
| D216,868 | S | * | 3/1970 | Britt | D9/185 |
| 3,501,080 | A | * | 3/1970 | Govatsos | 229/15 |
| 3,511,433 | A | * | 5/1970 | Andrews et al. | 299/44 |
| 3,547,569 | A | * | 12/1970 | Fenton et al. | 431/295 |
| 3,554,384 | A | | 1/1971 | De Natale | 206/45.31 X |
| 3,578,235 | A | * | 5/1971 | Weiss | 229/15 |
| 3,643,812 | A | * | 2/1972 | Mander et al. | 211/74 |
| 3,695,458 | A | * | 10/1972 | Nagel | 211/194 |
| 3,705,982 | A | * | 12/1972 | Smolinski | 240/604 |
| 3,743,473 | A | * | 7/1973 | Von Suskil | 431/289 |
| 3,929,230 | A | | 12/1975 | Luthi | 431/295 X |
| 3,932,113 | A | | 1/1976 | Thrush | 431/297 |
| 4,017,729 | A | * | 4/1977 | Frazier, Jr. | 240/13 |
| 4,038,937 | A | * | 8/1977 | Moe | 116/121 |
| 4,057,931 | A | * | 11/1977 | Stutelberg et al. | 206/509 |
| 4,159,769 | A | * | 7/1979 | Hatten et al. | 206/563 X |
| D262,913 | S | | 2/1982 | Glass | D26/13 |
| 4,355,485 | A | * | 10/1982 | Frank | 47/82 |

(List continued on next page.)

OTHER PUBLICATIONS

Candle Block™ candle holder sold by Design Ideas, Ltd. Offered for sale before Dec. 23, 1997.
Design Ideas, Catalogue, 1994, page front cover, 4 and 8.
Design Ideas, Catalogue, 1995, page front cover, back cover, and 4, 13–14, 17 and 19.
Horchow Collection: The Vase With Four Part Harmony; Design Digest; Feb. 1978; p. 21; Item J.

*Primary Examiner*—Alvin Chin-Shue
*Assistant Examiner*—Khoa Tran
(74) *Attorney, Agent, or Firm*—SAIDMAN DesignLaw Group

(57) ABSTRACT

Two illustrative candle holding modules, each of which have a plurality of openings for receiving candles therein for display and a plurality of projections which individually fit into a selected opening in other similar modules. The combination allows the building of an innumerable variety of three dimensional arrays of candles. One module includes a linear array of candle receiving cells with an equal number of projections beneath them, each cell and its associated projection being structurally related to allow combining a plurality of such modules together in a variety of arrangements. A second module includes a square array of identically sized and shaped cells and projections to interfit with other first or second type modules.

27 Claims, 6 Drawing Sheets

U.S. PATENT DOCUMENTS 4,406,616 A 9/1983 Greenvourcel ..... 431/295
D272,486 S * 2/1984 Benedetti ..... D7/38
4,569,655 A * 2/1986 Charette et al. ..... 431/290
D284,727 S * 7/1986 Gerber ..... D7/21
4,722,440 A * 2/1988 Johnston ..... 206/563 X
4,741,441 A * 5/1988 Keffeler ..... 206/561 X
4,759,699 A * 7/1988 Rubarth ..... 431/291
D305,192 S * 12/1989 Van Erkel ..... D7/38 X
4,887,790 A * 12/1989 Wilkinson et al. ..... 249/52
4,890,206 A 12/1989 Lee ..... 362/227
4,894,008 A * 1/1990 Lee ..... 431/290
4,933,193 A * 6/1990 Fisher ..... 426/107
4,989,733 A * 2/1991 Patry ..... 206/561 X
5,011,018 A * 4/1991 Keffeler ..... 206/561 X
5,094,060 A * 3/1992 Caird ..... 206/563 X
D333,615 S 3/1993 Zutler
D333,744 S * 3/1993 Zimmerman ..... D6/457
5,285,907 A 2/1994 Franchere et al. ..... 211/74
5,339,955 A * 8/1994 Horan et al. ..... 206/561 X
5,375,701 A * 12/1994 Hustad et al. ..... 206/45.18
5,419,080 A * 5/1995 Buss et al. ..... 47/73
5,660,281 A 8/1997 James ..... 206/563
5,695,057 A * 12/1997 Sullivan ..... 206/418
5,695,798 A * 12/1997 Rozzano ..... 206/561 X
D393,910 S 4/1998 Chambers et al.
5,786,643 A * 7/1998 Wyatt et al. ..... 219/621
D404,231 S * 1/1999 Woodring ..... D6/510
5,921,423 A 7/1999 Howell et al. ..... 220/23.86
D417,785 S * 12/1999 Daniels ..... D3/313
6,010,005 A * 1/2000 Reames et al. ..... 206/557
D420,283 S * 2/2000 Reichel ..... D9/347
6,039,563 A 3/2000 Hardy
D426,902 S 6/2000 Hardy et al.
6,247,192 B1 * 6/2001 Bostoen ..... 220/23.6
6,318,575 B1 * 11/2001 Lillelund et al. ..... 206/505

* cited by examiner 10
40
W
32
16
56
50
20
30
48
16
36
12
24
54
28
16
46
22
52
14
18
34
38
26

STACKING CANDLE HOLDER MODULES

BACKGROUND OF THE INVENTION

1. Field of the Invention

This invention relates to candle holders and, more particularly, to candle holding modules designed to permit stacking thereof in a stable, interlocking arrangement.

2. Description of Related Art

Candles and candle holders have been around since antiquity, and stacking candle holders is not new. Usually, however, the arrangements possible are limited to one or just a few. The following patents are representative:

U.S. Pat. No. Des. 262,913 issued to Glass shows cylindrical candle holders in which the cylindrical wall has been extended at the base where pairs of slots are cut therethrough. The slots receive the upper cylindrical rim of a pair of lower holders therein to interlock three or more holders together in pyramid form. The arrangement necessarily forces the upper holders to protrude into the chimney of the lower holder, constricting the access thereto for inserting and/or removing a candle. Further, the heat from the lower candles must impinge, somewhat deleteriously, on the upper holders. The present invention suffers not from this disadvantage.

U.S. Pat. No. 2,795,124 to Bruce is representative of stackable candelabrum in which a base for a candle is joined to other similar bases by means of rods which are friction fit into holes in the base. Bruce discloses a base with a centrally located candle receiving aperture surrounded by rod receiving holes. The arrangements resulting from joining one or more bases together are limited to linear, or closely staggered, rows of candles. U.S. Pat. No. 4,890,206 to Lee shows a variation of the Bruce arrangement. The present invention expands the versatility of the arrangements taught by the foregoing patents by permitting vertical as well as linear arrays.

U.S. Pat. No. 3,929,230 to Luthi permits vertical and linear arrangements of candles but requires three separate components to do so, namely, a candle-holding base for receiving the candle, a connecting clip for horizontally connecting one or more bases together, and a cylindrical plug for elevating one base above another. The present invention requires only one element, an integral candle holder having no moving parts which has the capability of receiving a plurality of candles while stacking vertically and horizontally with other similar holders.

U.S. Pat. No. 3,932,113 to Thrush discloses a candle holder having a base which fits within the candle receiving opening of a similarly shaped candle holder. Vertical stacking is permitted, but only one spire holding only one candle is possible. The present invention permits horizontal and vertical expansion for innumerable arrangements holding as many candles as one desires.

U.S. Pat. No. 4,406,616 to Greenvourcel provides for some versatility in arrangements for candles. It discloses a nesting system instead of a stacking system.

U.S. Pat. No. 3,554,384 to De Natale and U.S. Pat. No. 5,285,907 to Franchere et al. are typical of units which interlock with similar units by means of projections on one fitting into openings in the other. Article receiving openings are present, although not disclosed for use with candles, but since stacking would preclude use thereof, the units are unsuitable for building candelabra arrangements.

OBJECTS AND SUMMARY OF THE INVENTION

The present invention expands the versatility of the prior art as described above by providing a plurality of basic modules which can be stacked vertically and horizontally in a plurality of three dimensional arrangements while providing candle holding cells which are open and easily accessible.

The present invention accomplishes the above by providing a basic module having a plurality of open candle holding cells structurally related to a like plurality of projections for interlocking with candle holding cells of other modules.

It is an object of the invention to provide a simple, easily and economically manufactured module which permits unlimited three dimensional arrangements of stacked candle holders.

It is a further object of the invention to provide a plurality of module designs, all of which are capable of being stacked together in a stable, interlocking manner to provide opportunities for creative pleasing and decorative candle arrays.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
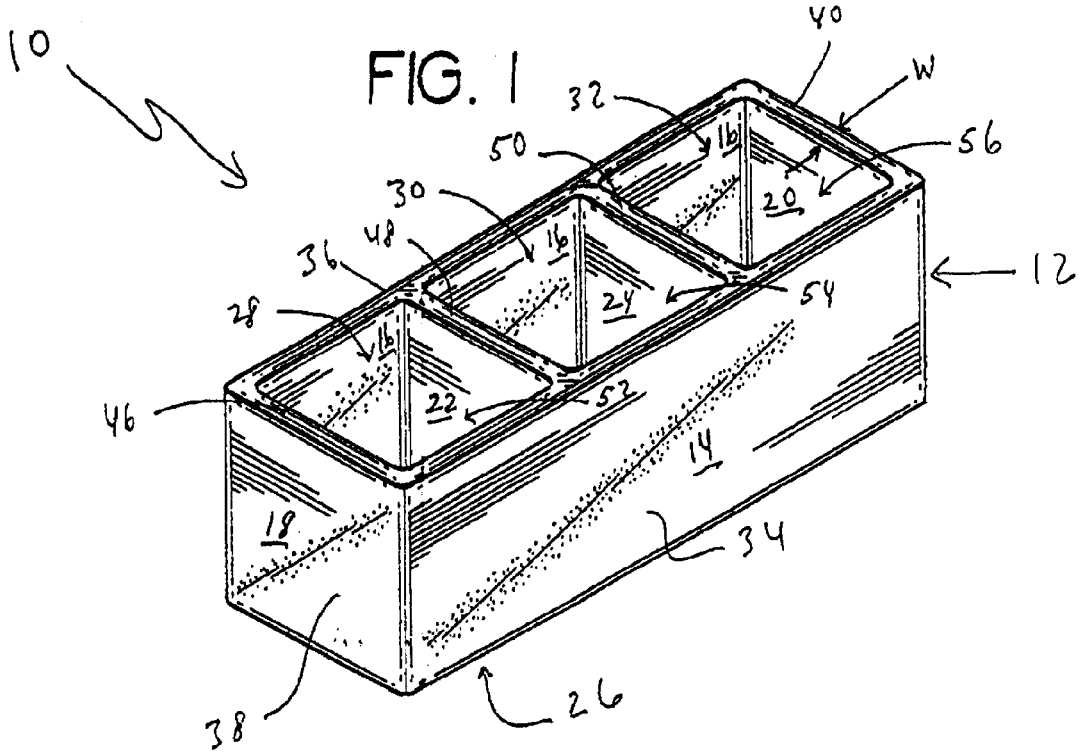
FIG. 1 is a perspective view which illustrates a preferred embodiment of one of the modules of the present invention.

Referring to FIG. 1, a first embodiment of the invention is shown as a stackable module 10 designed to hold and display candles, specifically candles of the votive type.

Module 10 is an integral structure with no moving parts, preferably made of transparent or translucent glass. Body or housing 12 thereof can be decoratively designed. It can be clear, cloudy, colored, or various combinations thereof, and can include decorative materials embedded within body or housing 12, such as simulated stars, snowflakes, geometric figures, or other images.

Figure 2:
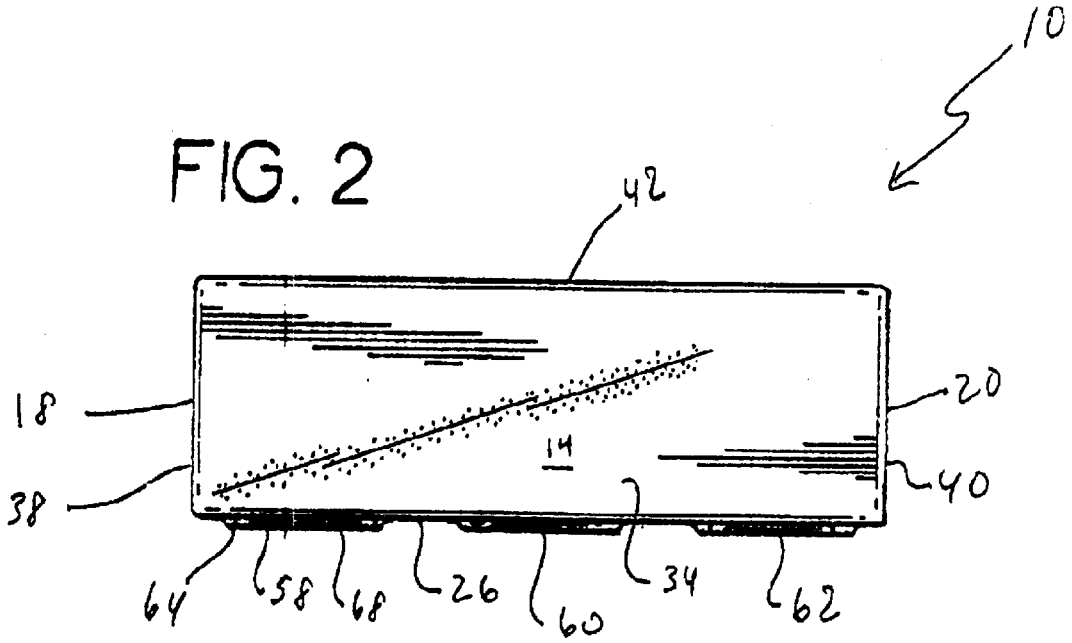
FIG. 2 is a side view of the module of FIG. 1.
Figure 3:
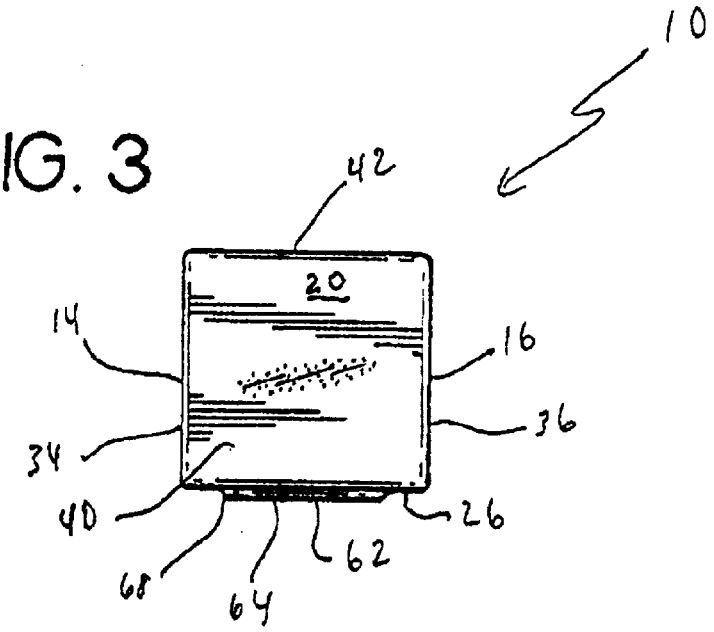
FIG. 3 is an end view of the module of FIG. 1.

Structurally, module 10 comprises parallel side walls 14 and 16, parallel end walls 18 and 20, and vertical dividers 22 and 24 which are parallel to end walls 18 and 20. Consequently, an outer wall is formed by side walls 14 and 16 and end walls 18 and 20. A bottom wall 26 (as shown in FIG. 2) closes the lower end of module 10. Bottom wall 26 will be discussed in detail relative to FIGS. 2, 3, and 5.

Three, essentially identical, candle-receiving cells are indicated generally by reference numerals 28, 30, and 32, and are defined by walls 14, 16, 18, and 20 and dividers 22 and 24. The outside surfaces 34, 36, 38 and 40 of walls 14, 16, 18, and 20, respectively, are preferably vertical, whereas their inside surfaces, visible in part in FIG. 1 and seen as portions 42 in FIG. 4, each taper inwardly at a small, preselected angle.

Walls 14, 16, 18, and 20 have similar thicknesses at corresponding distances from their top peripheral edge 46 to inside surface portions 44 of bottom wall 26. The top edges 48 and 50 of dividers 22 and 24 are flush with and have the same thickness as the top edge 46 of walls 14, 16, 18 and 20. Both interior side walls of each of dividers 22 and 24 taper inwardly at the same preselected angle. As a consequence, dividers 22 and 24 are slightly wider at their bottom portions than walls 14, 16, 18 and 20, but the interior shapes of cells 28, 30 and 32 are identical.

In this embodiment, cells 28, 30, and 32 are linearly aligned, but in other embodiments within the purview of the present invention, there could be a different number of cells, and/or they could be differently arranged. Cells 28, 30 and 32 comprise blind receptacles which open upwardly via openings 52, 54, and 56, respectively, defined by the top edges 46, 48, and 50 of walls 14, 16, 18 and 20 and dividers 22 and 24.

Figure 4:
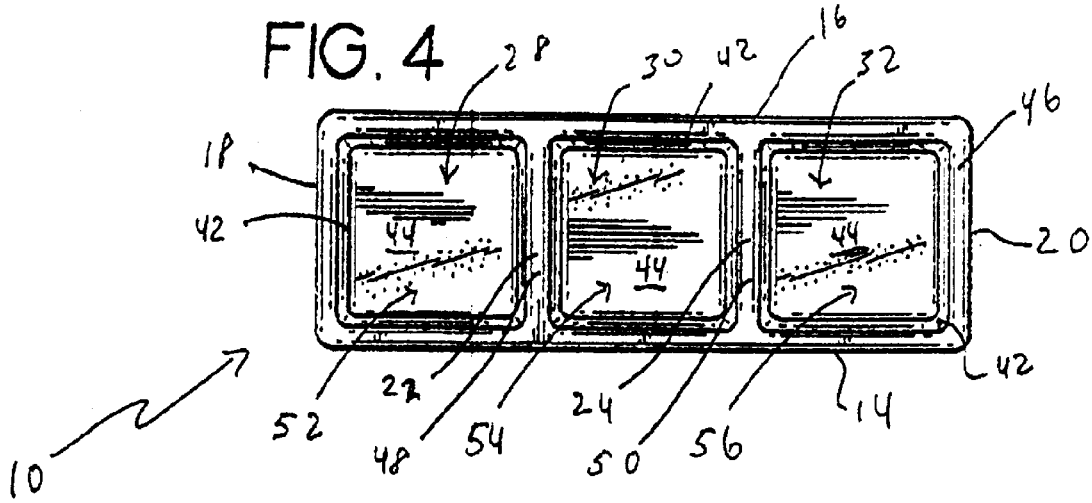
FIG. 4 is a top view of the module of FIG. 1.

As is more clearly seen in FIG. 4, openings 52, 54 and 56 each have the same internal size and shape. They are shown as square but could also be round, hexagonal, or any other interior outline which is symmetrical when viewed from orthogonal perspectives, as will become clear hereinafter.

Referring to FIGS. 2–5, the exposed surfaces of module 10 are shown. Extending downwardly from bottom wall 26 are three substantially identical projections 58, 60, and 62. As seen most clearly in FIG. 5, each of projections 58, 60, and 62 comprises a peripheral ridge 64 encompassing an interior 66. Interior 66 is shown as a concavity level with bottom wall 26, but it could as well be formed flush with the bottom edge 68 of ridge 64, or at any depth therebetween.

Figure 5:
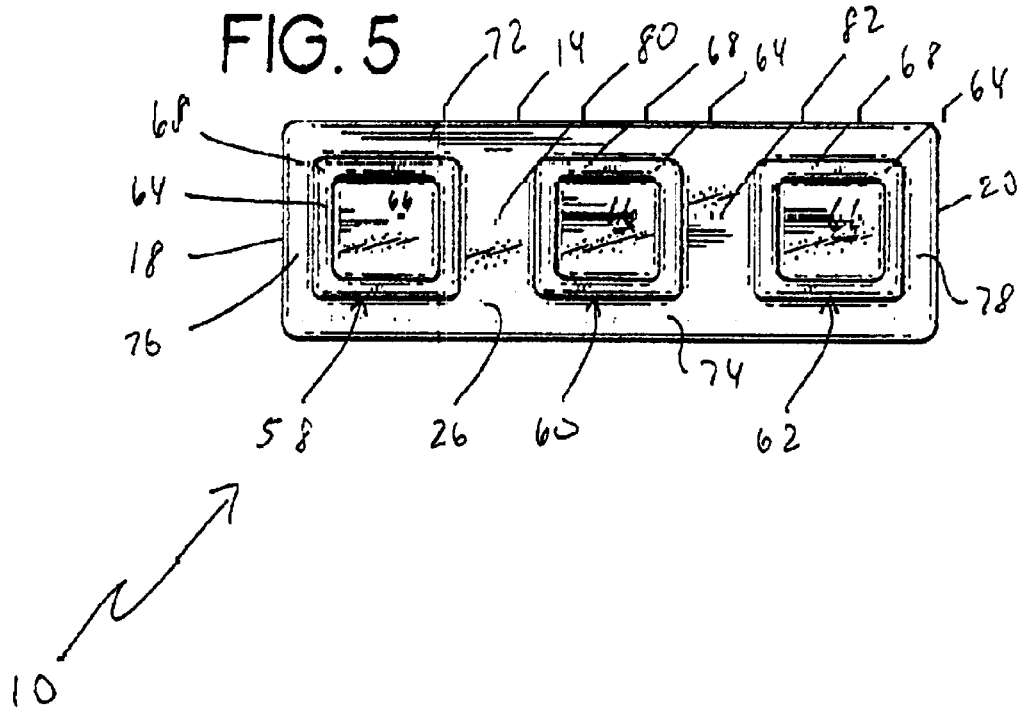
FIG. 5 is a bottom view of the module of FIG. 1.

Each of projections 58, 60 and 62 is substantially of the same configuration but of reduced size as each of openings 52, 54 and 56, as can be seen by comparing FIGS. 4 and 5. In the disclosed embodiment, all are square with projections 58, 60 and 62 smaller in corresponding dimensions than openings 52, 54 and 56. Should openings 52, 54 and 56 be of another peripheral shape, projections 58, 60 and 62 would follow suit.

Each of projections 58, 60 and 62 is linked with one of the openings 52, 54 and 56, being located directly beneath a respective one of the cells 28, 30 and 32, and they are similarly oriented, in that the corresponding sides of their similar shapes are parallel.

Although projections 58, 60 and 62 are located directly beneath corresponding cells 28, 30 and 32, they are not vertically aligned therewith but rather are slightly offset from vertical for a reason to be described. To better understand their relationship, refer to FIG. 5, where bottom wall 26 can be visualized as comprising a plurality of connecting strips, two identically dimensioned longitudinal strips 72 and 74 running adjacent the longitudinal edges of projections 58, 60 and 62, two identically dimensioned end strips 76 and 78 transversely connecting strips 72 and 74 at each end of module 10, and two identically dimensioned divider strips 80 and 82 transversely connecting strips 72 and 74 between projections 58 and 60 and projections 60 and 62, respectively. Taking the width W (FIG. 1) of top peripheral edge 46 of walls 14, 16, 18 and 20 as the reference standard, the relative widths of longitudinal strips 72 and 74 are almost twice W, the width of each of the end strips 76 and 78 are almost one and a half times larger than W, and the width of the divider strips 80 and 82 are each a little over three times W. These relative dimensions, while important inasmuch as they permit the stacking of modules in a plethora of orientations, are not to be construed as limitative, as there is room for variations in them.

Before describing a mode of using of module 10, reference will be made to FIGS. 6–9 which show a second embodiment of the invention.

Figure 6:
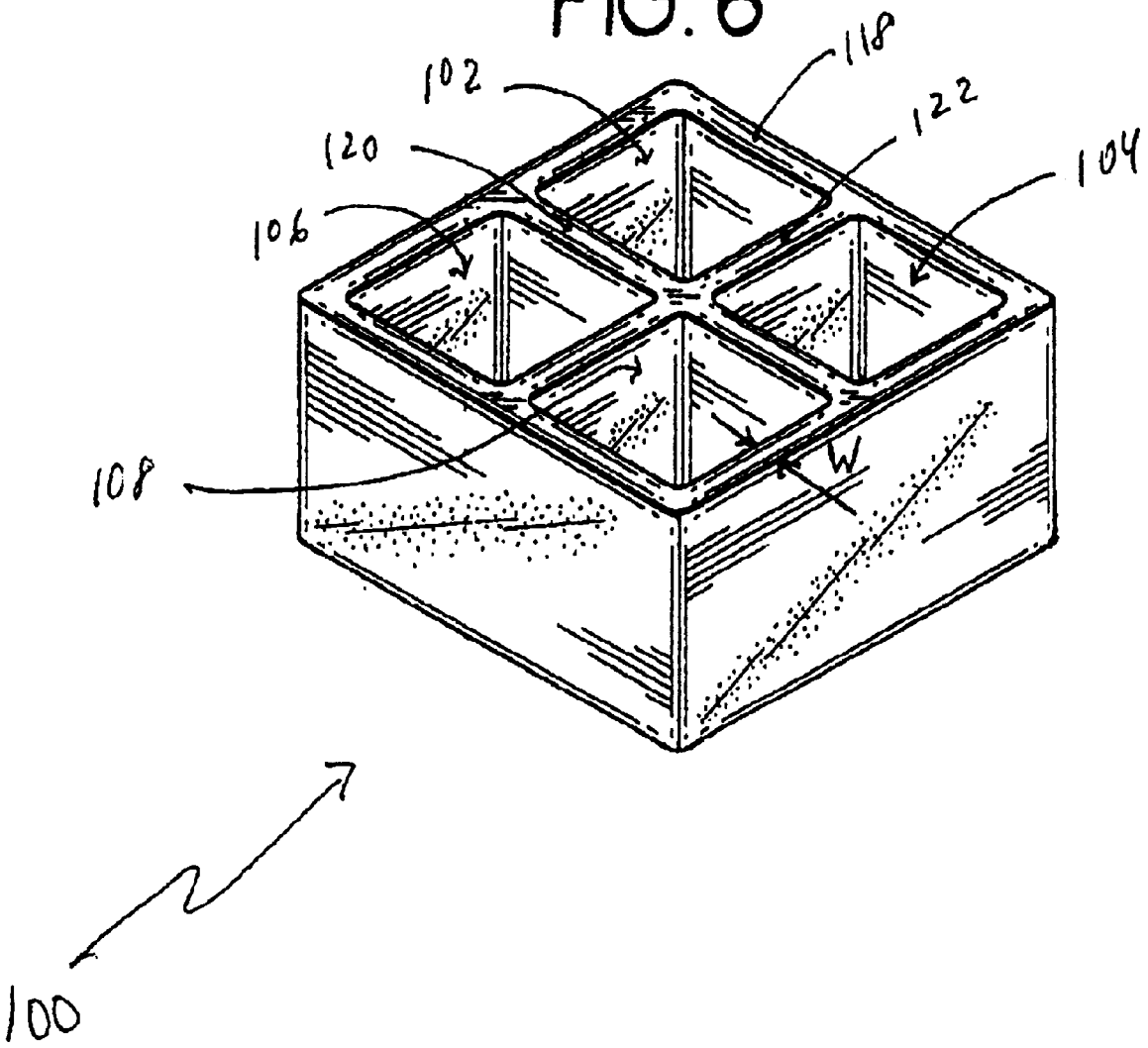
FIG. 6 is a perspective view which illustrates a preferred embodiment of a second module of the present invention.
Figure 7:
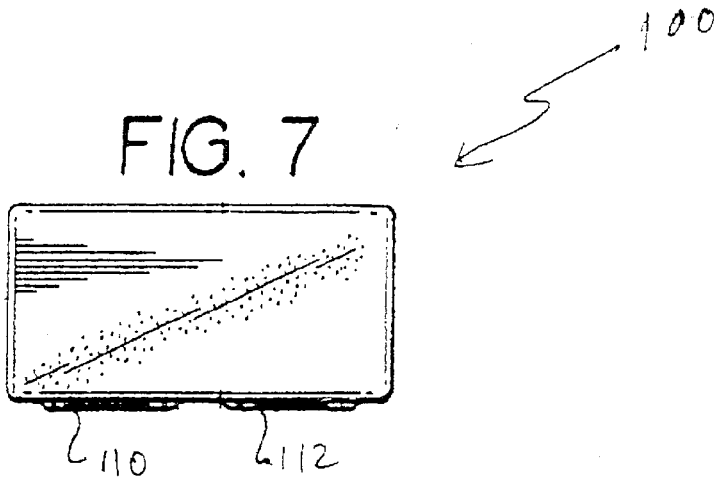
FIG. 7 is a side view of the module of FIG. 2.
Figure 8:
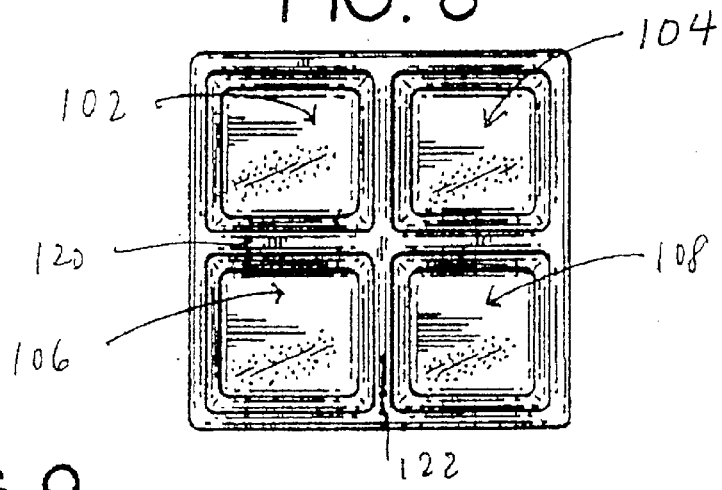
FIG. 8 is a top view of the module of FIG. 2.
Figure 9:
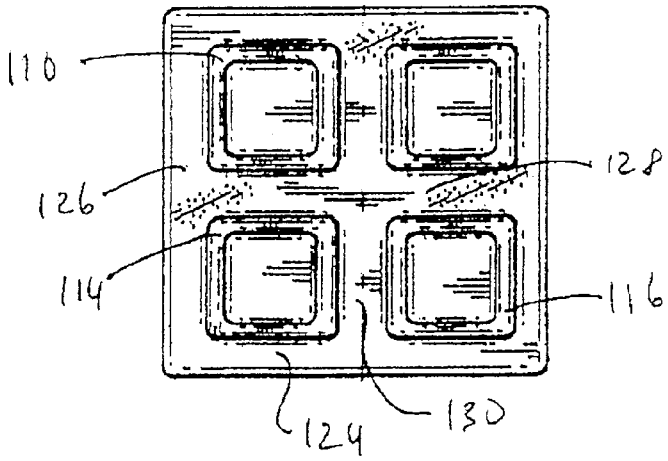
FIG. 9 is a bottom view of the module of FIG. 2.

FIG. 6 shows a perspective view of a second embodiment of the invention. A stackable module 100, designed to hold and display votive-type candles, comprises an integral structure which is similar in every way to module 10, except that module 100 has four cells 102, 104, 106, and 108 arranged relative to each other in the form of a square with two cells per side instead of the three-celled, linear arrangement of module 10.

The sizes and shapes of the defining structure of module 100, especially cells 102, 104, 106, and 108 (FIGS. 6 and 8) and projections 110, 112, 114, and 116 (FIGS. 7 and 9), are preferably substantially identical to their counterparts in module 10, including the one-to-one vertical but offset orientations linking cells and projections. All pertinent descriptions thereof carry over to module 100, therefore. Consequently, cells 102, 104, 106 and 108 are defined by vertical peripheral wall 118 (shown in FIG. 1) and divider walls 120 and 122. Likewise, the thicknesses of peripheral wall 118 and of divider walls 120 and 122 are as described relative to the functionally equivalent structure in module 10.

The most notable differences in the second embodiment results from the square arrangement of the cells as opposed to the previously described linear arrangement in the first embodiment. Divider walls 120 and 122 (FIG. 8) are perpendicular rather than parallel. Also, the dimensions of the connecting strips of bottom 124 (FIG. 9), namely, peripheral strip 126, and the identically dimensioned divider strips 128 and 130, are slightly different than the connecting strips 92, 74, 76, 78, 80 and of module 10. Again, taking the width W of top peripheral edge 118 (FIG. 6) as the reference standard, the relative width of the peripheral strip 126 is slightly more than the widths of end strips 76 and 78 but are the same width as longitudinal strips 72 and 74, namely, almost twice W. Divider strips 128 and 130 are slightly less in width than the widths of divider strips 80 and 82, leaving them a little less than three times W. With these dimensions, module 100 is stackable with module 10 as well as with other modules having the same design as module 100.

Figure 10:
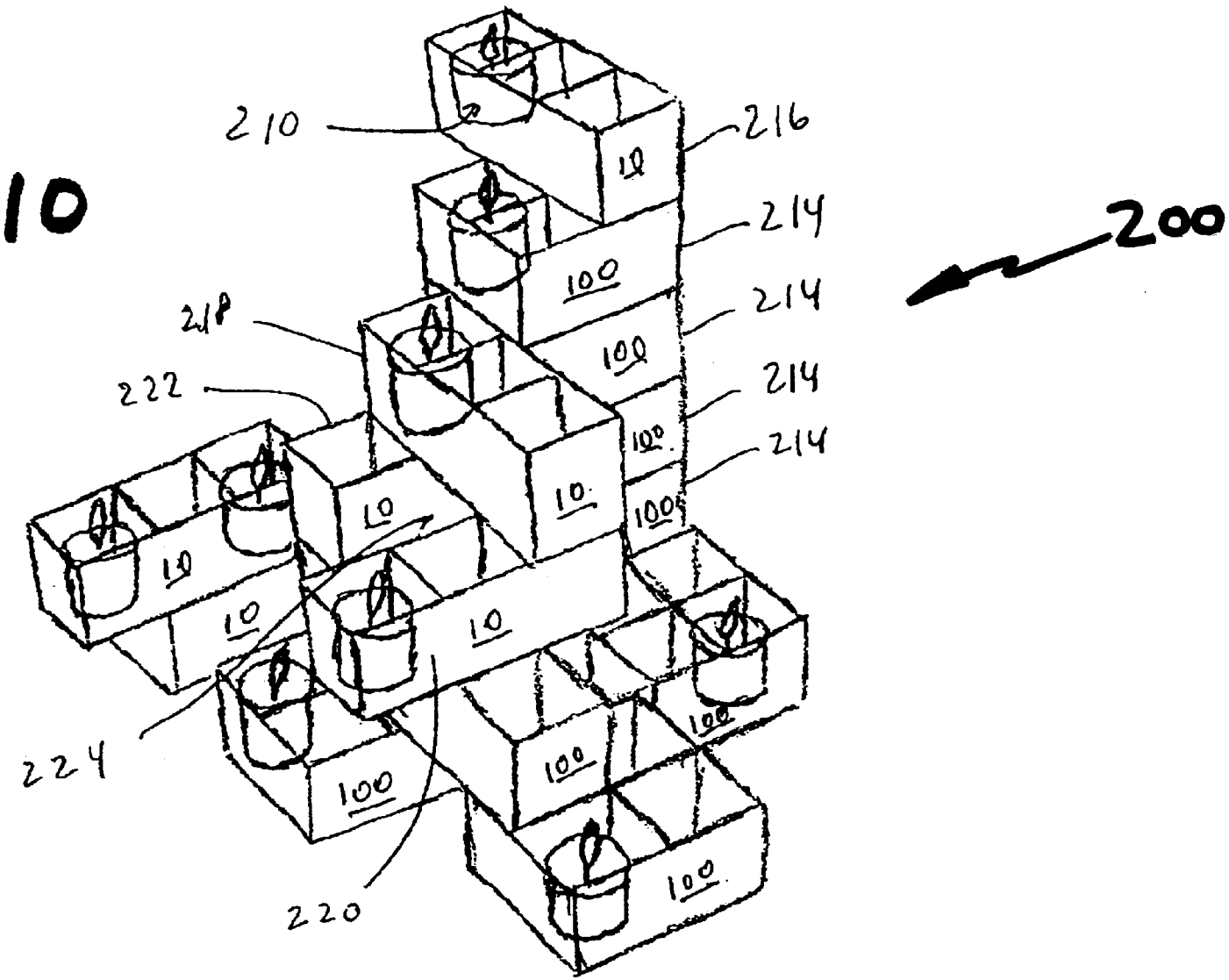
FIG. 10 illustrates one example of the manner in which the modules of the present invention can be stacked.

One possible array of modules 10 and 100, hereinafter referred to as linear and square modules, respectively, is shown in FIG. 10, where a plurality of each type of module has been stacked to provide a unique and pleasing arrangement 200. Arrangement 200 is but one of an innumerable number of different arrays available to creative minds.

It is clear from the above that cells 28, 30 and 32 and cells 102, 104, 106 and 108 are identical in size and shape. It is also clear that projections 58, 60 and 62 and projections 110, 112, 114 and 116 are also identical in size and shape, and that any one of the projections will fit loosely but stably in any one of the cells. The widths of the connecting strips between projections of both modules 10 and 100, namely, strips 80, 82, 128, and 130, are sufficient to span two thicknesses of any combination of side walls 18 and 20, peripheral sidewall 118, and dividers 22 and 24 and dividers 120 and 122. These relative dimensions, plus the offsets of the projections relative to their associated cell openings, permits placement of two modules of any type next to one another, and placement of another module on top of them with the connecting strip spanning the two adjacent walls while one or more projections of the top module fit within the cells of the lower modules, interlocking the modules together. These relationships permit the stacking of the disclosed linear and square modules in virtually any convenient and decorative arrangement.

As shown in FIG. 10, a mixture of linear modules 10 and square modules 100 has been effected by vertically stacking the modules in an offset arrangement. Votive candies 210 have been placed in selected open cells (i.e., uncovered cells in the modules) to create a pleasing and decorative arrangement. Note the use of a plurality of square modules 100 vertically stacked with the upper modules' four projections being received in the lower modules' four cells in order to form a base for elevating the candles in the square 214 and linear 216 modules at the top. Note also the placement of projections 58 and 62 of linear module 218 in the cells of two lower modules 220 and 222 which are separated by a void 224. The effect is an open tunnel through the arrangement. Other permutations, combinations, and probabilities will occur to those skilled in the art.

Square openings have been disclosed for ease of discussion, but it will be appreciated that other othogonally symmetrical shapes may be employed. For instance, hexagonal, octagonal, Star-of-David, pluses, X's, any other shapes which look the same when rotated ninety degrees can fit together such that their modules will also stack effectively.

Those skilled in the art wilt appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

We claim as our invention:

1. An apparatus comprising:

at least two candle holding modules each including
a housing further including
a bottom wall;
an outer wall extending upwardly from said bottom wall and said bottom wall and said outer wall defining an internal volume; and
at least one divider wall for dividing said internal volume into at least two cells, each cell having an upwardly extending opening, and each of said cells being sized to receive a candle;

wherein said candle holding modules are vertically stackable forming a lower candle holding module and an upper candle holding module, said upper candle holding module being offset from said lower candle holding module such that at least a portion of said bottom wall of said upper candle holding module rests atop said opening of at least one cell of said lower candle holding module forming a covered cell and at least one remaining cell of the lower candle holding module, and at least another portion of said bottom wall of said upper candle holding module is spaced from said opening of said at least one remaining cell of said lower candle holding module forming an uncovered cell of the lower candle holding module.

2. The apparatus of claim 1 wherein said housing is an integral structure having no moving parts.

3. The apparatus of claim 1 wherein said housing is transparent.

4. The apparatus of claim 1 wherein said housing is translucent.

5. The apparatus of claim 1 wherein said outer wall includes exterior and interior surfaces, said exterior surfaces being substantially vertical, said interior surfaces being tapered slightly inwardly at a preselected angle.

6. The apparatus of claim 5 wherein:

said outer wall includes a plurality of opposed, parallel side walls, said at least one divider wall being connected to two of said opposed, parallel side walls, said at least one divider wall having exposed surfaces, said exposed surfaces being tapered inwardly by said preselected angle.

7. The apparatus of claim 1 wherein said cells are of substantially the same size and shape.

8. The apparatus of claim 1 wherein said cells each have an opening which opens upwardly, said opening having a perimeter shape which is orthogonally symmetrical.

9. The apparatus of claim 8 wherein said perimeter shape is square.

10. The apparatus of claim 8 wherein each of said projections have a perimeter shape which is the same as said perimeter shape of said opening, the corresponding sides of said projection and said opening being parallel.

11. The apparatus of claim 10 wherein said perimeter shape of each of said projections is smaller than said perimeter shape of said opening.

12. The apparatus of claim 11 wherein each of said projections is offset from vertical alignment from its respective said opening.

13. The apparatus of claim 1 wherein said plurality of cells are linearly aligned.

14. The apparatus of claim 13 wherein the number of said plurality of cells is three.

15. The apparatus of claim 1 wherein said plurality of cells are arranged in the shape of a square.

16. The apparatus of claim 15 wherein the number of said plurality of cells is four.

17. The apparatus of claim 1 wherein said housing is made of glass.

18. The apparatus of claim 1 wherein each of said cells are substantially cubical in shape, and each of said projections are substantially square.

19. The apparatus of claim 1, wherein each of said cells has substantially the same size.

20. The apparatus of claim 1, wherein said top edge of said divider wall is generally flush with said top edge of said outer wall.

21. The apparatus of claim 1, wherein each of said housing modules further include at least two projections extending downwardly from said bottom wall, each of said at least two projections being located beneath a respective one of said at least two cells, wherein upon vertically stacking said candle holding modules at least one of said at least two projections extends within said covered cell.

22. A candle holder array comprising:

first and second housings, each including
a bottom wall;
a plurality of walls extending upwardly from said bottom wall and forming a top peripheral
edge, said bottom wall and said plurality of walls defining an internal volume;

at least one divider wall for dividing said internal volume into a plurality of candle holding cells; and a plurality of projections extending downwardly from said bottom wall, each of said projections being located beneath one of said cells;

wherein said first housing is stacked atop said second housing, at least a portion of said bottom wall of said first housing rests atop at least a portion of said top peripheral edge of said second housing, one of said plurality of projections of said first housing is vertically aligned with and located substantially within one of said cells of said second housing, and wherein no part of any of said plurality of cells of said first housing is located within any one of said plurality of cells of said second housing.

23. The candle holder array of claims 22, wherein each of said plurality of cells of said first housing is substantially the same size and shape as a respective one of said cells of said second housing.

24. The candle holder array of claim 22, wherein said first and second housings each further comprise a continuous, substantially planar divider strip located on said bottom wall between said at least two projections, wherein the width of said divider strip is at least twice the width of said top peripheral edge.

25. A candle holder array comprising:

first and second housings, each including:

a bottom wall;

a plurality of walls extending upwardly from said bottom wall and forming a top peripheral edge, said bottom wall and said plurality of walls defining an internal volume;

at least one divider wall for dividing said internal volume into a plurality of candle holding cells, the distance between said bottom wall and said top peripheral edge defining a cell height; and a plurality of projections extending downwardly from said bottom wall, each of said projections being located beneath a respective one of said cells;

wherein said first housing is stacked atop said second housing and one of said plurality of projections of said first housing is vertically aligned with and located substantially within one of said cells of said second housing, the overall height of said first and second stacked housings is no less than the sum of said cell height of said first housing and said cell height of said second housing.

26. A candle holder array comprising:

first, second and third housings, each including:

a bottom wall;

a plurality of side walls and a plurality of end walls extending upwardly from said bottom wall and forming a top peripheral edge, said bottom wall and said plurality of side walls defining an internal volume;

at least one divider wall for dividing said internal volume into a plurality of candle holding cells; and a plurality of projections extending downwardly from said bottom wall, each of said projections being located beneath a respective one of said cells;

wherein said first housing is stacked atop said second and third housings, one of said side walls of said second housing is parallel to and in contact with one of said side walls of said third housing, said side walls of said first housing are oriented perpendicular with respect to said side walls of said second housing and said side walls of said third housing, one of said plurality of projections of said first housing is located within one of said plurality of cells of said second housing, and a different one of said plurality of projections of said first housing is located within one of said plurality of cells of said third housing.

27. An arrangement comprising:

at least two candle holding modules each including a housing further including a bottom wall;

an outer wall extending upwardly from said bottom wall and said bottom wall and said outer wall defining an internal volume; and at least one divider wall for dividing said internal volume into at least two linearly aligned cells, each cell having an upwardly extending opening;

wherein said candle holding modules are vertically stackable forming a lower candle holding module and an upper candle holding module, said upper candle holding module being offset from said lower candle holding module such that at least a portion of said bottom wall of said upper candle holding module rests atop said opening of at least one cell of said lower candle holding module forming a covered cell and at least one remaining cell of the lower candle holding module, and at least another portion of said bottom wall of said upper candle holding module is spaced from said opening of said at least one remaining cell of said lower candle holding module forming an uncovered cell of the lower candle holding module.

* * * * *